US007104199B2

(12) United States Patent
Walker et al.

(10) Patent No.: US 7,104,199 B2
(45) Date of Patent: Sep. 12, 2006

(54) METHOD AND APPARATUS FOR SMOKELESS PYROTECHNIC DISPLAY

(76) Inventors: Ronald R. Walker, 10 Countryman Creek Rd., Columbus, MT (US) 59019; Russell R. Nickel, 736 E. 1st Ave. N., Columbus, MT (US) 59019

( * ) Notice: Subject to any disclaimer, the term of this patent is extended or adjusted under 35 U.S.C. 154(b) by 78 days.

(21) Appl. No.: 10/782,026

(22) Filed: Feb. 19, 2004

(65) Prior Publication Data

US 2004/0159259 A1 Aug. 19, 2004

Related U.S. Application Data

(60) Provisional application No. 60/448,304, filed on Feb. 19, 2003.

(51) Int. Cl.
*F42B 4/22* (2006.01)

(52) U.S. Cl. ..... 102/342; 102/351; 102/357

(58) Field of Classification Search ..... 102/357, 102/351, 336, 342, 345, 360
See application file for complete search history.

(56) References Cited

U.S. PATENT DOCUMENTS 2,442,528 A * 6/1948 Beattle ..... 102/340
2,459,687 A * 1/1949 Decker ..... 102/342
3,349,707 A * 10/1967 Wortley, Jr. et al. ..... 102/346
5,269,224 A * 12/1993 Gonzales et al. ..... 102/288

FOREIGN PATENT DOCUMENTS

GB 2 162 622 A * 2/1986

* cited by examiner

*Primary Examiner*—Stephen M. Johnson
(74) *Attorney, Agent, or Firm*—Polster, Lieder, Woodruff & Lucchesi, L.C.

(57) ABSTRACT

A pyrotechnic display device configured to ignite solid pyrotechnic compositions or aerial shells within a launch tube prior to propelling them on a desired arc. A smokeless pyrotechnic propelling charge is disposed within the launch tube below the solid pyrotechnic compositions, and separated therefrom. An ignition source is disposed in operative relationship to the pyrotechnic compositions or aerial shells, which are ignited prior to ignition of the smokeless pyrotechnic propelling charge.

4 Claims, 2 Drawing Sheets

METHOD AND APPARATUS FOR SMOKELESS PYROTECHNIC DISPLAY

CROSS-REFERENCE TO RELATED APPLICATIONS

The present application is related to, and claims priority from, U.S. Provisional Patent Application Ser. No. 60/448,304 filed on Feb. 19, 2003.

STATEMENT REGARDING FEDERALLY SPONSORED RESEARCH

Not Applicable.

BACKGROUND OF THE INVENTION

The present invention relates generally to pyrotechnic display devices commonly referred to as fireworks, and in particular, to a pyrotechnic display device configured to produce an aerial shell, comet, or mine which, when ignited, smokelessly expels either non-burning body containing a burst charge and stars, or a solid pyrotechnic color or effect, to generate a reduced smoke aerial display, comet display, or star display.

Traditionally, black power is used in the majority of pyrotechnic display devices for igniting and propelling solid pyrotechnic compositions such as star or comet displays from a launch tube. Black powder offer the advantages of rapid and hot combustion, thereby propelling the solid pyrotechnic compositions from the launch tubes to a desired apex while simultaneously providing sufficient heat to ignite the composition, a prime explosive, or a delay fuse on an aerial shell.

It is known however, that black powder propellant produces a large volume of smoke during combustion. This is particularly troublesome for pyrotechnic display devices intended for use within a building interior, such as an enclosed arena or stadium, or for use outside if the pyrotechnic display devices or aerial shells are discharged in close proximity to spectators, exhibitors, or other activities which would be obscured or impeded by the significant smoke produced during combustion.

A smokeless propellant which is commonly utilized in firearms is to provide an expelling force for a projectile is nitrocellulose. However, the use of nitrocellulose in entertainment pyrotechnic display devices is not common because nitrocellulose combustion occurs at a relatively low temperature. Low temperature combustion of nitrocellulose provides sufficient force to propel solid pyrotechnic compositions from a launch tube to a desired apex, but lacks a sufficient heat of combustion to ignite the compositions, their primes, or the delay fuses on aerial shells. Traditionally, nitrocellulose use in display pyrotechnic devices is limited to expelling non-burning items such as confetti, or it is utilized as a noise maker in party poppers and novelty devices.

Accordingly, there is a need in the industry for a display pyrotechnic device which is capable of both igniting solid pyrotechnic compositions, their primes, or aerial delay fuses and propelling the burning composition or aerial shell on a desired arc from a launch tube with a minimum amount of smoke.

BRIEF SUMMARY OF THE INVENTION

Briefly stated, a first embodiment the present invention provides a pyrotechnic display device configured to ignite solid pyrotechnic compositions within a launch tube prior to propelling them on a desired arc. A propelling charge of nitrocellulose is disposed within the launch tube below the solid pyrotechnic compositions, and separated therefrom by a gas-sealing disk. The an upper surface of the gas-sealing disk, adjacent the solid pyrotechnic compositions is optionally coated with a pyrotechnic prime compositions to facilitate rapid and uniform ignition of the solid pyrotechnic compositions. A combustion delay material disposed over an axial bore in the gas-sealing disk ensures ignition of the solid pyrotechnic compositions prior to combustion of the nitrocellulose propelling charge. A plurality of optional radial gas ports or vents are disposed in the launch tube adjacent the mouth or bore opening through which the ignited solid pyrotechnic compositions are expelled by the propellant.

A second embodiment the present invention provides a pyrotechnic aerial shell device configured to ignite a delay fuse associated with a non-burning body containing a burst charge or pyrotechnic stars within a launch tube prior to propelling the non-burning body on a desired arc. A propelling charge of nitrocellulose is disposed within the launch tube below the non-burning body, and separated therefrom by a gas-sealing disk. The an upper surface of the gas-sealing disk, adjacent the non-burning body is optionally coated with a pyrotechnic prime compositions to facilitate rapid ignition of the delay fuse. A combustion delay material disposed over an axial bore in the gas-sealing disk ensures ignition of the delay fuse prior to combustion of the nitrocellulose propelling charge. A plurality of optional radial gas ports or vents are disposed in the launch tube adjacent the mouth or bore opening through which the non-burning body and ignited delay fuse are expelled by the propellant.

A method of the present invention provides for assembling a pyrotechnic display device capable of propelling an ignited solid pyrotechnic composition with a minimal discharge of smoke. A launch tube having a closed base and an open bore is loaded with a nitrocellulose propellant charge. A gas sealing and lifting disk having an axial bore is installed within the open bore, enclosing the nitrocellulose propellant charge. A combustion delay component, such as a Styrofoam disk is dispose over the axial bore of the gas sealing and lifting disk. At least one solid pyrotechnic composition is placed in the open bore, on the upper surface of the gas sealing and lifting disk, and a paper cap or burst disk is utilized to retain the at least one slid pyrotechnic composition and components within the open bore. One or more electrical igniters or fuses or placed in operative relation to the at least one solid pyrotechnic composition.

A method of the present invention for igniting a smokeless pyrotechnic device includes the steps of igniting, within a launch tube, a pyrotechnic prime material in proximity to a fast burning cored pressed pyrotechnic composition. Upon propagation of flame about the surface of the cored pressed pyrotechnic composition, igniting a smokeless propellant charge disposed below the cored pressed pyrotechnic composition within the launch tube, thereby expelling the ignited pyrotechnic composition from the launch tube along a desired arc.

An alternate method of the present invention for igniting a smokeless aerial shell pyrotechnic display device includes the steps of igniting, within a launch tube, a delay fuse associated with a burst charge or plurality of pyrotechnic stars contained with a non-burning body. Upon ignition of the delay fuse, a smokeless propellant charge disposed below the non-burning body within the launch tube is ignited, thereby expelling the ignited aerial shell from the launch tube along a desired arc.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

As used herein, the term smokeless is intended to describe pyrotechnic applications which generate significantly less visible smoke than found in traditional black-powder pyrotechnic applications. The term is not intended to be limiting to only pyrotechnic applications which produce no visible smoke.

To achieve the intended purpose of the present invention, i.e. to provide a smokeless pyrotechnic display device or aerial shell, it is necessary to utilize a launch tube configured to create sufficient pressure from the combustion of a smokeless pyrotechnic propellant to launch a previously ignited pyrotechnic composition or a non-burning body with a previously ignited delay fuse to a desired altitude, while simultaneously avoiding premature extinguishment of the pyrotechnic composition or aerial shell delay fuse from high velocity lift gasses or surrounding airflow.

Figure 1:
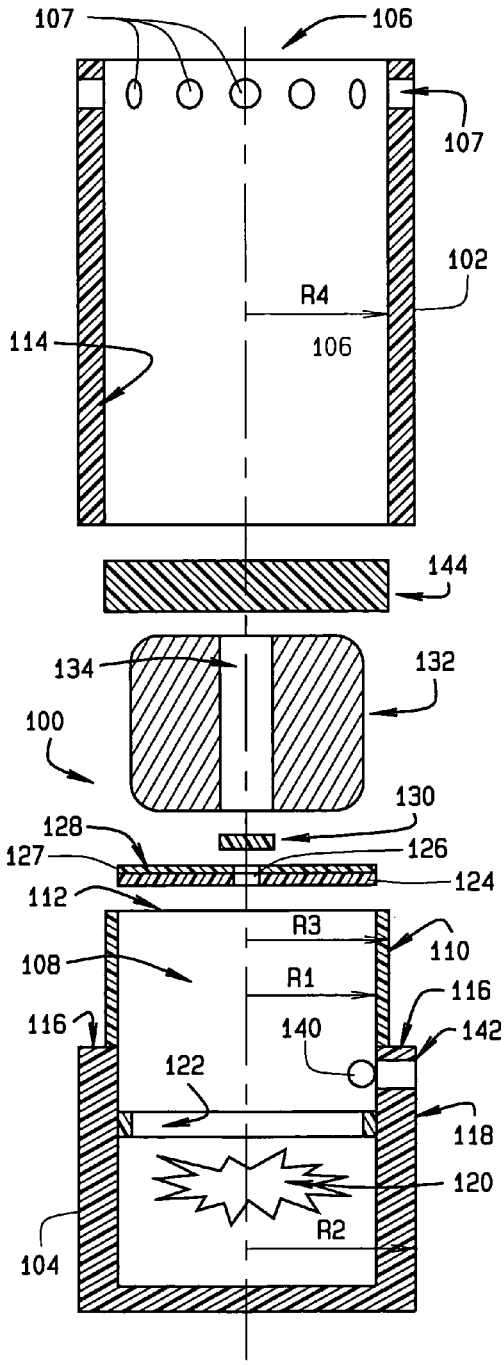
FIG. 1 is an exploded sectional view of the components of a first embodiment of a smokeless pyrotechnic display device of the present invention.
Figure 2:
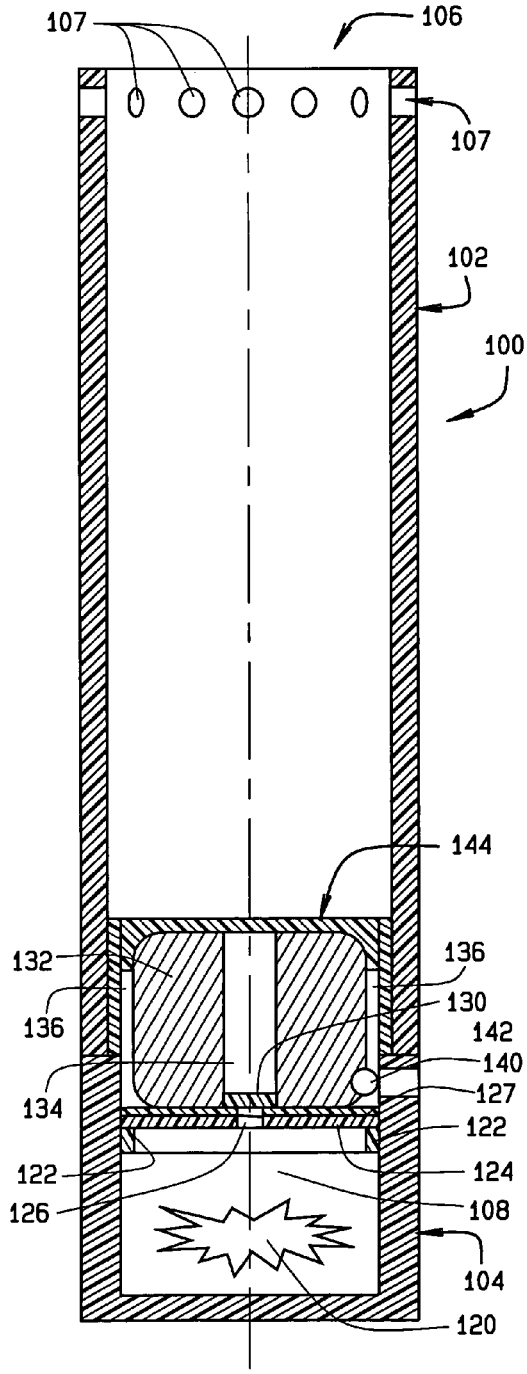
FIG. 2 is a sectional view of the assembled components of a the smokeless pyrotechnic display device of FIG. 1.

Turning to FIG. 1 and FIG. 2, a first embodiment of the pyrotechnic display device 100 of the present invention is illustrated. The pyrotechnic display device 100 consists of a launch tube or barrel 102 having a generally cylindrical configuration and an enclosed base 104 The launch tube or barrel 102 preferably formed from spiral wound paper having an open discharge end 106, but may consist of any of a wide variety of materials having sufficient strength to maintain a shape during ignition and combustion of the pyrotechnic display device 100. Optional radial gas vents 107 may be disposed adjacent the open discharge end 106. The enclosed base 104 is preferably formed from a molded plastic, defining a open-ended combustion chamber 108, and is configured for attachment to the launch tube or barrel 102, opposite the open discharge end 106.

As illustrated in FIGS. 1 and 2, the enclosed base 104 is generally cylindrical, having a uniform inner radial dimension $R_1$, and a uniform outer radial dimension $R_2$. An annular recessed region 110 is provided adjacent an open end 112 of the combustion chamber 108. The annular recessed region 110 maintains the uniform inner radial dimension $R_1$, but has a reduced uniform outer radial dimension $R_3$, sized to receive the inner cylindrical surface 114 of the launch tube or barrel 102, having an inner radial dimension $R_4$, in an interference fit, abutting an annular ridge 116 on the outer surface 118 of the enclosed base 104.

Those of ordinary skill in the art will recognize that the enclosed base 104 may optionally be constructed integrally with the launch tube or barrel 102, or coupled thereto in a variety of different manners, and may consist of any of a variety of shapes and sizes, depending upon the particular application for which the pyrotechnic device 100 is to be utilized.

A smokeless lift charge or pyrotechnic propellant 120, preferably nitrocellulose, is placed within combustion chamber 108 of the enclosed base 104. The quantity of smokeless pyrotechnic propellant 120 is selected in a conventional manner, based upon the combustion characteristics of the smokeless pyrotechnic propellant 120 and the particular loads which are intended to be ejected from the launch tube or barrel 102.

Disposed above the level of the smokeless pyrotechnic propellant 120 within the combustion chamber 108 of the enclosed base 104, a radially inward projecting shoulder 122 supports a gas sealing disk 124. The gas sealing disk 124 includes an axial bore or passage 126, and is sized to fit securely within the combustion chamber 108 when seated on the shoulder 122. Optionally, a conventional pyrotechnic prime composition 127 is deposited on an upper surface 128 of the gas sealing disk, opposite from the smokeless pyrotechnic propellant 120. A combustion delay component 130 is disposed within the combustion chamber 108, above the gas sealing disk 124, and in axial alignment with the axial bore or passage 126. The combustion delay component 130 preferably is formed from Styrofoam or a similar combustion delay material.

Next, one or more pyrotechnic compositions 132 are disposed within the combustion chamber 108, with the initial pyrotechnic composition 132 seated on the upper surface 128 of the gas sealing disk. Each pyrotechnic composition 132 is preferably formed as a pressed solid, and includes a open central core 134. The outer radial dimensions of each pyrotechnic composition 132 is selected to be smaller than the inner radial dimension $R_4$ of the launch tube or barrel 102, thereby providing a combustion facilitating air-gap 136 between the sides of each pyrotechnic composition 132 and the launch tube or barrel 102. The specific chemical structure of each pyrotechnic composition 132 is selected based on conventional parameters such as desired combustion color, effects, or combustion duration.

One or more ignition sources 140, such as an electric igniter or primer cord are passed through a igniter passage 142 in the enclosed base 102, preferable disposed above the shoulder 122 and gas sealing disk 124, and adjacent an outer surface of the pyrotechnic composition 132 and optional pyrotechnic prime composition 127 disposed on the gas sealing disk upper surface 128. Additional ignitions sources may optionally be similarly disposed adjacent the outer surfaces of each additional pyrotechnic composition 132 present in the combustion chamber 108.

Finally, a closure cap or burst disk 144, preferably composed of paper, is fittingly seated within the launch tube or barrel 102, between the uppermost pyrotechnic composition 132 and the open discharge end 106, thereby retaining the installed components within the launch tube or barrel 102 during storage and transportation.

During use, the previously described components are assembled within the enclosed base 104 and launch tube or barrel 102 in a logical and sequential manner, as dictated by the manner in which the components are to be propelled from the open discharge end 106.

To discharge the smokeless pyrotechnic display device 100 of the present invention, the one or more ignition sources 140 are utilized to igniting the pyrotechnic compositions 132 and optional prime composition 127 within the combustion chamber 108. The optional pyrotechnic prime composition 127 is disposed in combustion proximity to the pyrotechnic composition 132 facilitating propagation of flame over the exposed surfaces of the adjacent pyrotechnic composition 132 within the combustion chamber 108.

Following flame propagation over the surfaces of the pyrotechnic compositions 132, the combustion delay component 130 separating the pyrotechnic composition 132 from the smokeless pyrotechnic propellant 120 burns through. Continued combustion of the pyrotechnic compositions 132 results in the igniting of the smokeless pyrotechnic propellant 120 through the now-exposed axial bore or passage 126 in the gas sealing disk 124, and the expelling of the ignited pyrotechnic compositions 132 from the discharge end 106 of the launch tube or barrel 102.

Figure 3:
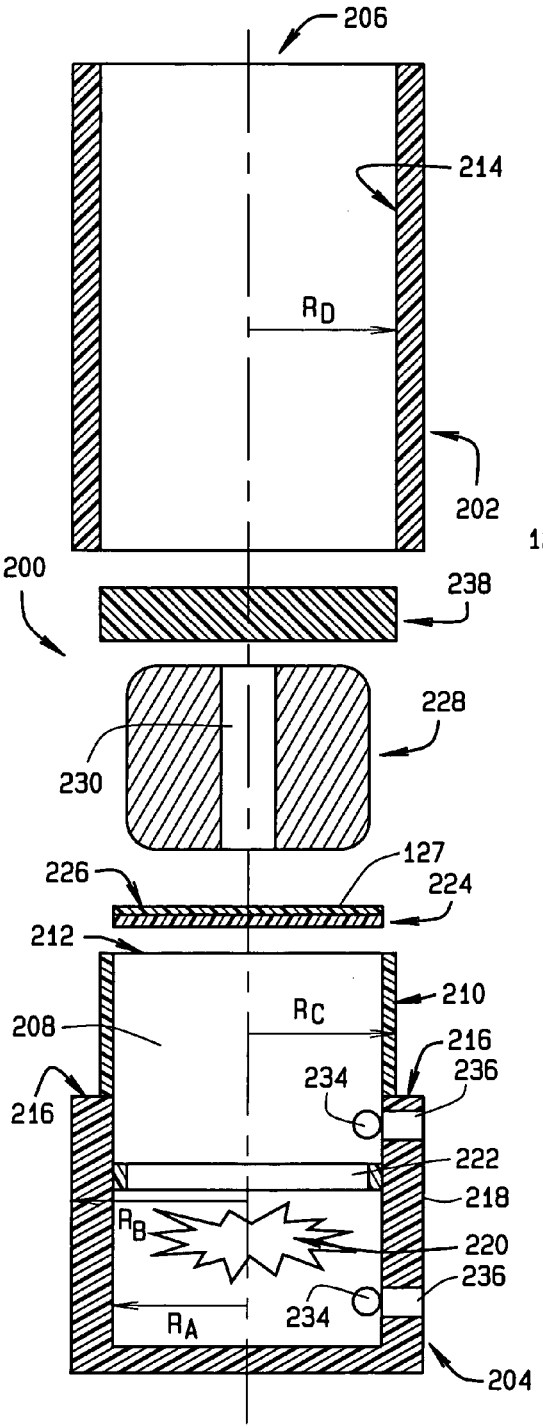
FIG. 3 is an exploded sectional view of the components of a second embodiment of a smokeless pyrotechnic display device of the present invention.
Figure 4:
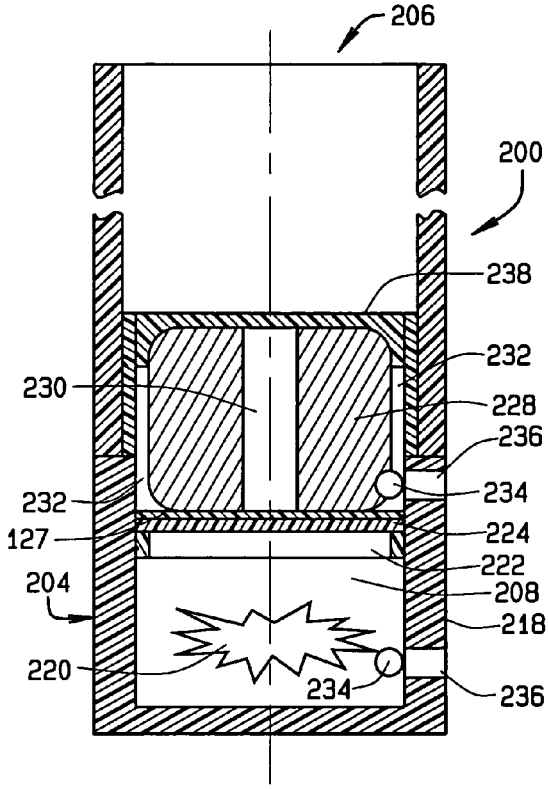
FIG. 4 is a sectional view of the assembled components of a the smokeless pyrotechnic display device of FIG. 3.

Turning to FIG. 3 and FIG. 4, a second embodiment of the pyrotechnic display device 200 of the present invention is illustrated. The pyrotechnic display device 200 consists of a launch tube or barrel 202 having a generally cylindrical configuration and an enclosed base 204. The launch tube or barrel 202 preferably formed from spiral wound paper having an open discharge end 206, but may consist of any of a wide variety of materials having sufficient strength to maintain a shape during ignition and combustion of the pyrotechnic display device 200. The enclosed base 204 is preferably formed from a molded plastic, defining a open-ended combustion chamber 208, and is configured for attachment to the launch tube or barrel 202, opposite the open discharge end 206.

As illustrated in FIGS. 3 and 4, the enclosed base 204 is generally cylindrical, having a uniform inner radial dimension RA, and a uniform outer radial dimension RB. An annular recessed region 210 is provided adjacent an open end 212 of the combustion chamber 208. The annular recessed region 210 maintains the uniform inner radial dimension R1, but has a reduced uniform outer radial dimension R3, sized to receive the inner cylindrical surface 214 of the launch tube or barrel 202, having an inner radial dimension R4, in an interference fit, abutting an annular ridge 216 on the outer surface 218 of the enclosed base 204.

Those of ordinary skill in the art will recognize that the enclosed base 204 may optionally be constructed integrally with the launch tube or barrel 202, or coupled thereto in a variety of different manners, and may consist of any of a variety of shapes and sizes, depending upon the particular application for which the pyrotechnic device 200 is to be utilized.

A smokeless lift charge or pyrotechnic propellant 220, preferably nitrocellulose, is placed within combustion chamber 208 of the enclosed base 204. The quantity of smokeless pyrotechnic propellant 220 is selected in a conventional manner, based upon the combustion characteristics of the smokeless pyrotechnic propellant 220 and the particular loads which are intended to be ejected from the launch tube or barrel 202.

Disposed above the level of the smokeless pyrotechnic propellant 120 within the combustion chamber 208 of the enclosed base 204, a radially inward projecting shoulder 222 supports a gas sealing disk 224. The gas sealing disk 224 is sized to fit securely within the combustion chamber 208 when seated on the shoulder 222. Optionally, a conventional pyrotechnic prime composition 127 is deposited on an upper surface 226 of the gas sealing disk, opposite from the smokeless pyrotechnic propellant 220.

Next, one or more pyrotechnic compositions 228 are disposed within the combustion chamber 208, with the initial pyrotechnic composition 228 seated on the upper surface 226 of the gas sealing disk 224. Each pyrotechnic composition 228 is preferably formed as a pressed solid, and includes a open central core 230. The outer radial dimensions of each pyrotechnic composition 228 is selected to be smaller than the inner radial dimension Rd of the launch tube or barrel 202, thereby providing a combustion facilitating air-gap 232 between the sides of each pyrotechnic composition 228 and the launch tube or barrel 202. The specific chemical structure of each pyrotechnic composition 228 is selected based on conventional parameters such as desired combustion color, effects, or combustion duration.

Two or more ignition sources 234, such as an electric igniter or primer cord are passed through associated igniter passages 236 in the enclosed base 202. One ignition source 234 and associated igniter passage 236 is disposed below the shoulder 222 and gas sealing disk 224, in proximity to the smokeless pyrotechnic propellant 122. At least a second ignition source 234 and associated igniter passage 236 is disposed above the shoulder 222 and gas sealing disk 224, adjacent an outer surface of the lowest pyrotechnic composition 228 and optional pyrotechnic prime composition 127 disposed on the gas sealing disk upper surface 226. Additional ignitions sources may optionally be similarly disposed adjacent the outer surfaces of each additional pyrotechnic composition 228 present in the combustion chamber 208.

Finally, a closure cap or burst disk 238, preferably composed of paper, is fittingly seated within the launch tube or barrel 202, between the uppermost pyrotechnic composition 228 and the open discharge end 206, thereby retaining the installed components within the launch tube or barrel 202 during storage and transportation.

During use, the previously described components are assembled within the enclosed base 204 and launch tube or barrel 202 in a logical and sequential manner, as dictated by the manner in which the components are to be propelled from the open discharge end 206.

To discharge the smokeless pyrotechnic display device 200 of the present invention, the one or more ignition sources 234 disposed above the gas sealing disk 224 are utilized to igniting the pyrotechnic compositions 228 and optional prime composition 127 within the combustion chamber 208. The optional pyrotechnic prime composition 127 is disposed in combustion proximity to the lowest pyrotechnic composition 228 facilitating propagation of flame over the exposed surfaces of the adjacent pyrotechnic composition 228 within the combustion chamber 208.

Following flame propagation over the surfaces of the pyrotechnic compositions 228, or after a predetermined time delay, the ignition source 234 disposed below the gas sealing disk 224 and in proximity to the smokeless pyrotechnic propellant 220 is utilized to ignite the smokeless pyrotechnic propellant 220. Combustion of the smokeless pyrotechnic propellant 220 results in the expelling of the ignited pyrotechnic compositions 228 from the discharge end 206 of the launch tube or barrel 202. Utilization of the ignition source 234 disposed below the gas sealing disk 224 allows for precision timing in the launching of the device 200, and does not rely on the potentially random combustion of priming compositions or delay elements.

Figure 5:
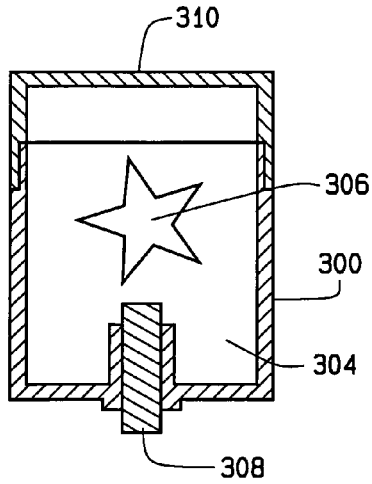
FIG. 5 is a sectional view of an aerial shell embodiment of the present invention.

In an alternate embodiment of the present invention, the pyrotechnic compositions 132 and 228 may be replaced with aerial shells 300, such as shown in FIG. 5. An aerial shell 300 preferably consists of a non-burning body 302, formed from plastic or paper materials, defining a hollow chamber 304 within which are disposed one or more burst charges or pyrotechnic stars 306. A delay fuse 308 protrudes through the non-burning body 302. During use or discharge, the delay fuse 308 of the aerial shell 300 is ignited first, followed by ignition of the smokeless pyrotechnic propellant 120, 220 as previously described either from burn-through of a combustion delay element 130 or a separate igniter 234. The resulting combustion of the smokeless pyrotechnic propellant 120, 220 launches the aerial shell 300. Preferably, the delay fuse 308 is selected to ignite the burst charges or pyrotechnic stars 306 at the apex of the aerial shell flight path, bursting the non-burning body 302 either along frangible lines, or by detaching a removable cap 310, providing the desired pyrotechnic display.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A reduced diminished smoke pyrotechnic display device comprising:

an enclosed base defining an open ended combustion chamber;

a launch tube coupled to said enclosed base about said open ended combustion chamber, said launch tube having a discharge end;

a diminished smoke pyrotechnic propellant disposed in said combustion chamber;

an ignitable pyrotechnic display element disposed within said combustion chamber between said diminished smoke pyrotechnic propellant and said launch tube discharge end, wherein said ignitable pyrotechnic display element is an aerial shell consisting of a non-burning body having a hollow core within which is contained at least one pyrotechnic charge and having an ignitable delay fuse associated with said at least one pyrotechnic charge for ignition by said controlled ignition source;

a controlled ignition source disposed in proximity to said aerial shell; and a means to ignite said diminished smoke pyrotechnic propellant delayed from ignition of said at least one pyrotechnic charge.

2. The diminished smoke pyrotechnic device of claim 1 wherein said diminished smoke pyrotechnic propellant is nitrocellulose.

3. The diminished smoke pyrotechnic display device of claim 1 wherein said means to ignite said diminished smoke propellant is a combustion delay element disposed between said controlled ignition source and said diminished smoke pyrotechnic propellant.

4. The diminished smoke pyrotechnic display device of claim 1 wherein said means to ignite said diminished smoke pyrotechnic propellant is a second controlled ignition source, said second controlled ignition source disposed in proximity to said diminished smoke pyrotechnic propellant and controlled to ignite after ignition of said pyrotechnic display element.

* * * * *